US006854433B2

(12) United States Patent
Vanderpoel

(10) Patent No.: US 6,854,433 B2
(45) Date of Patent: Feb. 15, 2005

(54) INTEGRATED PRIMARY AND AUXILIARY VALVE ACTUATION SYSTEM

(75) Inventor: Richard Vanderpoel, Bloomfield, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 6 days.

(21) Appl. No.: 10/342,178

(22) Filed: Jan. 15, 2003

(65) Prior Publication Data

US 2003/0188703 A1 Oct. 9, 2003

Related U.S. Application Data

(60) Provisional application No. 60/369,879, filed on Apr. 5, 2002.

(51) Int. Cl.[7] ..... F01L 1/34

(52) U.S. Cl. ..... 123/90.16; 123/90.12; 123/90.46; 123/90.41

(58) Field of Search ..... 123/90.16, 90.46, 123/90.12, 90.41; 60/533–594

(56) References Cited

U.S. PATENT DOCUMENTS

| | | | | |
|---|---|---|---|---|
| 4,134,371 A | * | 1/1979 | Hausknecht | 123/90.43 |
| 4,153,016 A | * | 5/1979 | Hausknecht | 123/90.15 |
| 4,483,283 A | * | 11/1984 | Hausknecht | 123/90.46 |
| 5,537,976 A | * | 7/1996 | Hu | 123/322 |
| 5,829,397 A | | 11/1998 | Vorih et al. | |
| 6,321,701 B1 | * | 11/2001 | Vorih et al. | 123/90.12 |

* cited by examiner

*Primary Examiner*—Thomas Denion
*Assistant Examiner*—Zelatem Eshete
(74) *Attorney, Agent, or Firm*—Collier Shannon Scott

(57) ABSTRACT

A system and method for actuating at least one engine valve in an internal combustion engine to produce an engine valve event is disclosed. The system of the present invention may comprise: means for imparting motion to the at least one engine valve for producing the engine valve event; primary means for transmitting the motion from the motion imparting means to the at least one engine valve; and auxiliary means for transmitting the motion from the motion imparting means to the at least one engine valve. The auxiliary means may actuate the at least one engine valve only when the primary means is shut-off or fails.

20 Claims, 5 Drawing Sheets

INTEGRATED PRIMARY AND AUXILIARY VALVE ACTUATION SYSTEM

This application claims the benefit of Provisional Application No. 60/369,879, filed Apr. 5, 2002.

FIELD OF THE INVENTION

The present invention relates generally to a system and method for actuating a valve in an internal combustion engine. In particular, the present invention relates to a system and method that may be used to actuate an engine valve under fail safe conditions.

BACKGROUND OF THE INVENTION

Valve actuation in an internal combustion engine is required in order for the engine to produce positive power, as well as to produce engine braking. During positive power, intake valves may be opened to admit fuel and air into a cylinder for combustion. The exhaust valves may be opened to allow combustion gas to escape from the cylinder. Intake and exhaust valves may also be opened during positive power at various times to recirculate gases for improved emissions.

During engine braking, the exhaust valves may be selectively opened to convert, at least temporarily, an internal combustion engine of compression-ignition type into an air compressor. In doing so, the engine develops retarding horsepower to help slow the vehicle down. This can provide the operator with increased control over the vehicle and substantially reduce wear on the service brakes of the vehicle.

In many internal combustion engines the engine cylinder intake and exhaust valves may be opened and closed by fixed profile cams in the engine, and more specifically by one or more fixed lobes which may be an integral part of each of the cams. The use of fixed profile cams can make it difficult to adjust the timings and/or amounts of engine valve lift to optimize valve opening times and lift for various engine operating conditions, such as different engine speeds.

One method of adjusting valve timing and lift, given a fixed cam profile, has been to provide variable valve actuation and incorporate a "lost motion" device in the valve train linkage between the valve and the cam. Lost motion is the term applied to a class of technical solutions for modifying the valve motion proscribed by a cam profile with a variable length mechanical, hydraulic, or other linkage assembly. In a lost motion system, a cam lobe may provide the "maximum" (longest dwell and greatest lift) motion needed over a full range of engine operating conditions. A variable length system may then be included in the valve train linkage, intermediate of the valve to be opened and the cam providing the maximum motion, to subtract or lose part or all of the motion imparted by the cam to the valve.

This variable length system (or lost motion system) may, when expanded fully, transmit all of the cam motion to the valve, and when contracted fully, transmit none or a minimum amount of the cam motion to the valve. An example of such a system and method is provided in Hu, U.S. Pat. Nos. 5,537,976 and 5,680,841, which are assigned to the same assignee as the present application and which are incorporated herein by reference.

In the lost motion system of U.S. Pat. No. 5,680,841, an engine cam shaft may actuate a master piston which displaces fluid from its hydraulic chamber into a hydraulic chamber of a slave piston. The slave piston in turn acts on the engine valve to open it. The lost motion system may include a solenoid trigger valve and/or a check valve in communication with the hydraulic circuit including the chambers of the master and slave pistons. The solenoid valve may be maintained in a closed position in order to retain hydraulic fluid in the circuit. As long as the solenoid valve remains closed, the slave piston and the engine valve respond directly to the motion of the master piston, which in turn displaces hydraulic fluid in direct response to the motion of a cam. When the solenoid is opened temporarily, the circuit may partially drain, and part or all of the hydraulic pressure generated by the master piston may be absorbed by the circuit rather than be applied to displace the slave piston, and correspondingly, the engine valve.

Previous lost motion systems have typically not utilized high speed mechanisms to rapidly vary the length of the lost motion system. Lost motion systems of the prior art have accordingly not been variable such that they may assume more than one length during a single cam lobe motion, or even during one cycle of the engine. By using a high speed mechanism to vary the length of the lost motion system, more precise control may be attained over valve actuation, and accordingly optimal valve actuation may be attained for a wide range of engine operating conditions.

The lost motion system and method of the present invention may be particularly useful in engines requiring variable valve actuation for positive power, engine braking valve events (such as, for example, compression release and bleeder braking), and exhaust gas recirculation valve events. Each of the foregoing events not only make the engine operate, but also relieve the high pressures and temperatures that occur in the engine. If left uncontrolled, which may occur with the failure of a lost motion system, positive power, engine braking, and/or exhaust/intake gas recirculation could result in pressure or temperature damage to an engine. Moreover, if the exhaust valve should fail to open during positive power, the "exhaust" stroke will actually be an engine compression stroke starting with an abnormally high cylinder pressure. The peak cylinder pressures produced could be substantially higher than the structural limits of the engine. Therefore, it may be beneficial to have a lost motion system which is capable of providing exhaust valve events should the lost motion system fail.

The present invention provides such a system. The present invention is a valve actuation system capable of automatically and virtually immediately providing at least a portion of a desired engine valve event should the lost motion system fail.

One advantage of an embodiment of the present invention is that it may provide a system and method for actuating at least one engine valve should a primary variable valve actuation system fail to operate.

Another advantage of an embodiment of the present invention is that it may provide a system and method for actuating at least one engine valve should a primary variable valve actuation system be turned off.

Another advantage of an embodiment of the present invention is that it may provide a system and method for automatically actuating at least one engine valve using an auxiliary system should a primary variable valve actuation system fail to operate.

Another advantage of an embodiment of the present invention is that it may provide a system and method for virtually immediately actuating at least one engine valve using an auxiliary system should a primary variable valve actuation system fail to operate.

Additional advantages of the invention are set forth, in part, in the description which follows and, in part, will be apparent to one of ordinary skill in the art from the description and/or from the practice of the invention.

SUMMARY OF THE INVENTION

The present invention is directed to a system and method for actuating at least one engine valve in an internal combustion engine to produce at least a portion of an engine valve event. The system of the present invention may comprise: means for imparting motion to the at least one engine valve for producing the engine valve event; primary means for transmitting the motion from the motion imparting means to the at least one engine valve; and auxiliary means for transmitting the motion from the motion imparting means to the at least one engine valve. The auxiliary means may actuate the at least one engine valve only when the primary means is shut-off or fails.

The method of the present invention may comprise a method of actuating at least one engine valve to produce at least a portion of an engine valve event during failure of shut-off of a lost motion system connecting a means for imparting motion to the engine valve. The method of the present invention may comprise the steps of: providing an actuation means extending from the motion imparting means; and actuating the engine valve to produce at least a portion of the engine valve event independent of the lost motion system.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

In order to assist the understanding of this invention, reference will now be made to the appended drawings, in which like reference characters refer to like elements. The drawings are exemplary only, and should not be construed as limiting the invention.

DETAILED DESCRIPTION OF THE PRESENT INVENTION

Reference will now be made in detail to embodiments of the system and method of the present invention, examples of which are illustrated in the accompanying drawings. As embodied herein, the present invention is a system and method of controlling the actuation of at least one engine valve.

Figure 1:
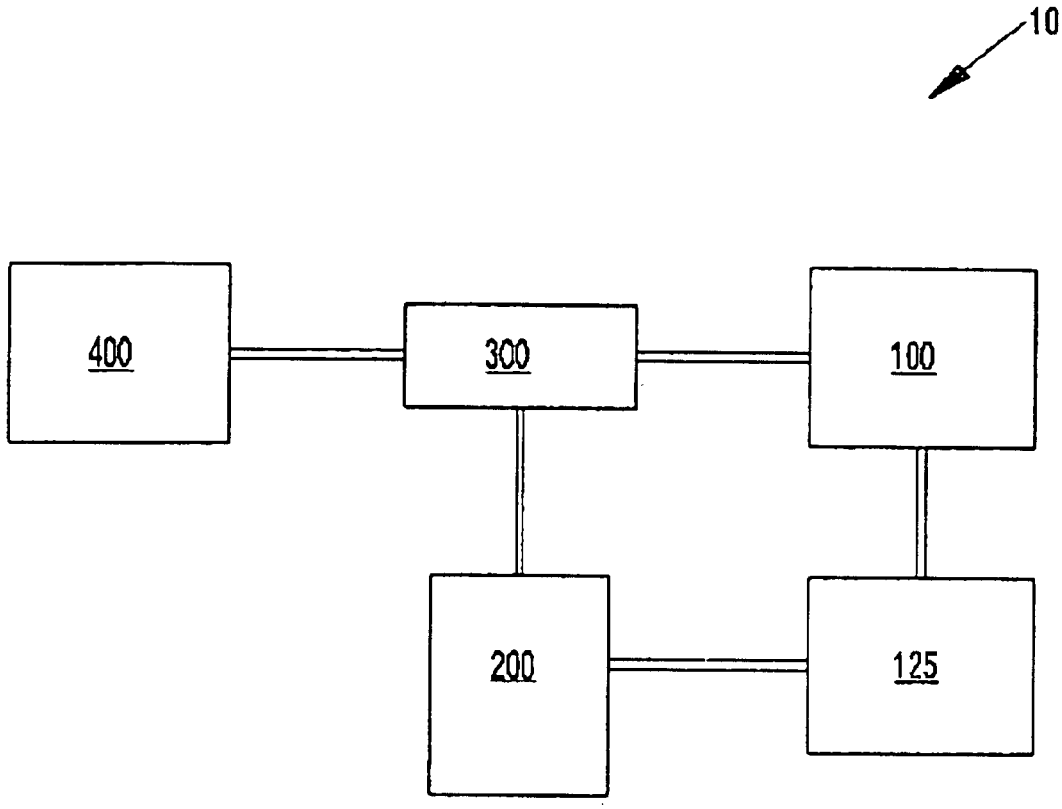
FIG. 1 is a schematic diagram of a valve actuation system according to a first embodiment of the present invention.

An embodiment of the present invention is shown in FIG. 1 as valve actuation system 10. The valve actuation system 10 of the present invention includes a lost motion system or variable length primary system 300 which connects a means for imparting motion 100 with at least one engine valve 200. In this manner, the motion imparting means 100 provides motion to open the valve 200 and produce various engine valve events through the primary system 300. The valve actuation system 10 further includes an auxiliary system 125 (i.e., means for automatic actuation of the valve 200) for use in case of failure and/or shut-off of the primary system 300. The valve actuation system 10, including the length of the primary system 300, may be controlled by a control means 400. It is contemplated that the at least one engine valve 200 may include an exhaust valve, an intake valve, and/or a dedicated valve.

The motion imparting means 100 may comprise any combination of cam(s), push tube(s), and/or rocker arm(s), or their equivalents. The primary system 300 may comprise any structure that connects the motion imparting means 100 to the valve 200 and is capable of transmitting motion from the motion imparting means 100 to the valve 200. The primary system 300 may comprise any linkage, such as, for example, a mechanical linkage, a hydraulic circuit, a hydromechanical linkage, an electromechanical linkage, and/or any other linkage adapted to connect to the motion imparting means 100 and transmit motion to the valve 200. The primary system 300 may include means for providing the appropriate length of the linkage, such as, for example, trigger valve(s), check valve(s), accumulator(s), and/or other devices necessary to properly operate the primary system 300. As will be apparent to those of ordinary skill in the art, the primary system 300 may be located at any point in the valve train connecting the motion imparting means 100 and the valve 200.

The control means 400 may comprise any electronic or mechanical device for communicating with the primary system 300 and selecting the length of the primary system 300. As will be apparent to those of ordinary skill in the art, the control means 400 may include a microprocessor, linked to other engine components and/or sensors, to determine and select the appropriate length of the primary system 300. Valve actuation may be optimized at a plurality of engine speeds by controlling the length of the primary system 300 based upon information collected at the microprocessor from engine components. Preferably, the control means 400 operates the primary system 300 at high speed (one or more times per engine cycle), but this feature is not required.

An embodiment of the present invention will now be described with reference to FIG. 2. The motion imparting means 100 may comprise a cam 110, and a rocker 120. The motion imparting means 100 is adapted to act on a single valve 200, or on multiple valves 200 through a valve bridge 250 (as shown in FIG. 2).

The cam 110 includes at least one cam lobe for producing an engine valve event. The engine valve events produced by the cam 110 may include, but are not limited to, any one or more of the following: a main exhaust event, a main intake event, a compression release braking event, a bleeder braking event, an intake recirculation event, and/or an exhaust gas recirculation (EGR) event.

Figure 2:
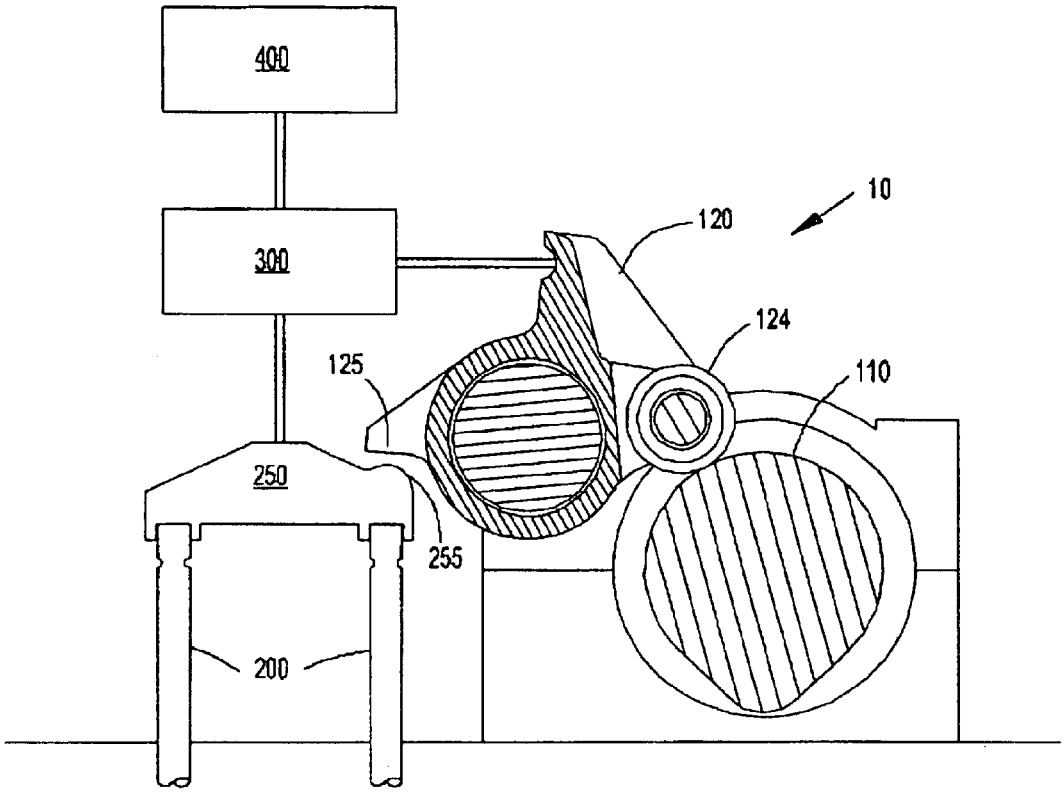
FIG. 2 is a schematic diagram of a valve actuation system according to a second embodiment of the present invention.
Figure 3:
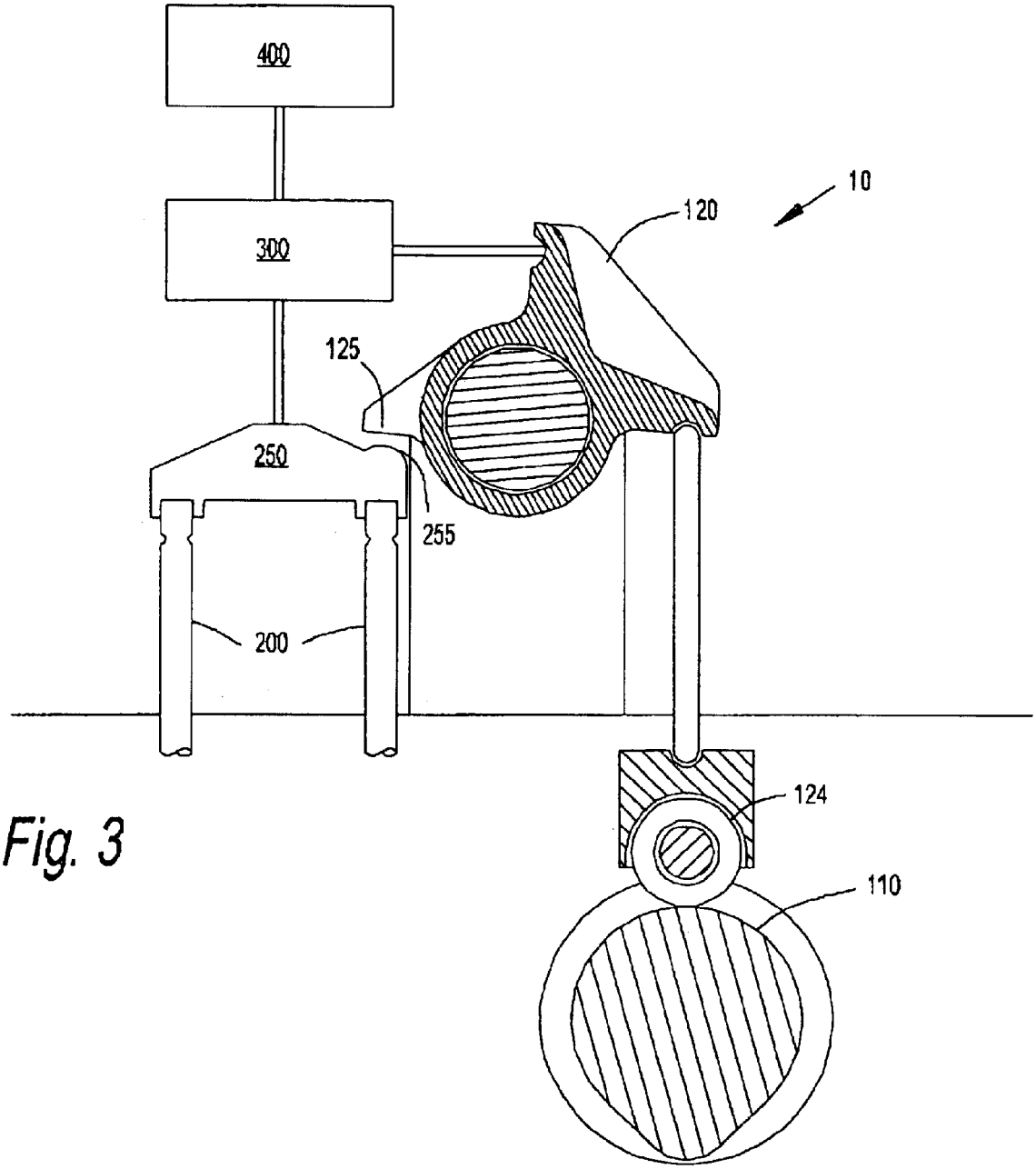
FIG. 3 is a schematic diagram of a valve actuation system according to a third embodiment of the present invention.

With continued reference to FIG. 2, the rocker 120 may include a roller 124 for contacting the surface of the cam 110. As the cam 110 rotates, the roller 124 follows the surface of the cam 110, causing the rocker 120 to rotate. As the rocker 120 rotates, the rocker 120 is adapted to transfer the motion of the cam to the primary system 300. As the motion is transferred through the primary system 300, the valve 200 is actuated to produce the engine valve event. The amount of motion transferred from the motion imparting means 100 to the valve 200 is controlled by the instantaneous length of the primary system 300. It is contemplated that the motion imparting means 100 may further comprise a push tube assembly, as shown in FIG. 3.

The actuation means 125 is adapted to automatically actuate the valve 200 to produce at least a portion of the appropriate engine valve event if the primary system 300 is shut-off or otherwise fails to properly transmit the motion from the motion imparting means 100 to the valve 200. In this manner, the actuation means 125 actuates the valve 200 independent of the primary system 300. In an embodiment of the present invention, as shown in FIG. 2, the actuation means 125 is integrated with the motion imparting means 100. The actuation means 125 may comprise a rocker projection which extends from the rocker 120 for automatic mechanical actuation of the valve 200.

The valve actuation system 10 may further comprise a contact surface 255 on the valve bridge 250. During failure of the valve actuation system 10, which may occur due to failure of the primary system 300 caused by, for example, a hydraulic circuit leak or a trigger valve failing to close properly, or during shut-off, the actuation means 125 is adapted to contact the contact surface 255, causing the bridge 250 to tilt, and actuate the valve 200, at least partially, to produce at least a portion of the appropriate engine valve event. In the embodiment of the present invention wherein the motion imparting means 100 is adapted to act on a single valve 200, it is contemplated that the contact surface 255 may be directly on the valve 200.

Figure 5:
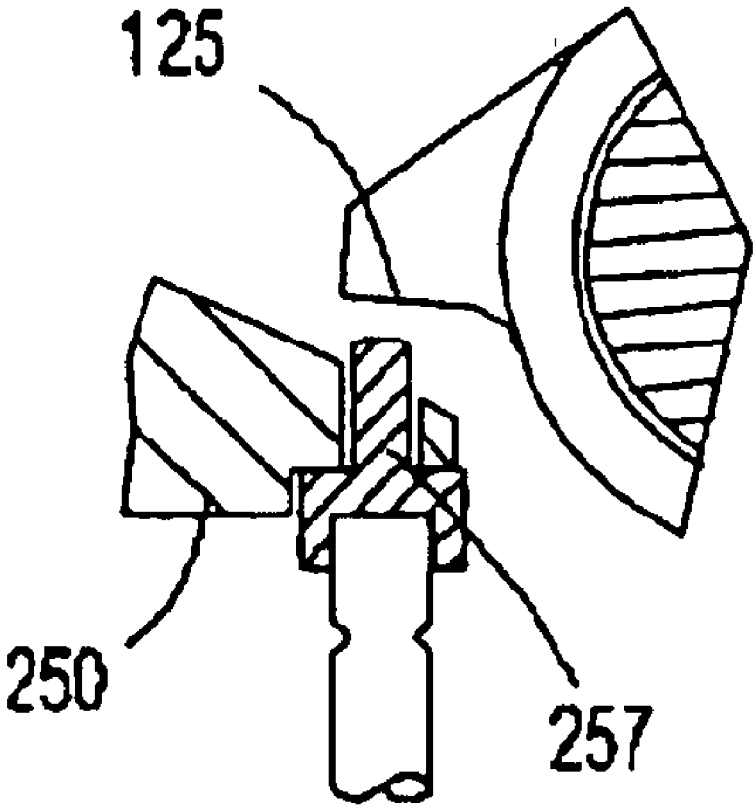
FIG. 5 is a schematic diagram of a portion of the valve actuation system used in an embodiment of the present invention.

In an alternative embodiment of the present invention, as shown in FIG. 5, the valve actuation system 10 may further comprise a pin 257 slidably located in the valve bridge 250. During failure or shut-off, the actuation means 125 contacts the pin 257, which then actuates the valve 200. The pin 257 may result in less tilting action on the bridge 250, and, thus, reduce wear.

Figure 4:
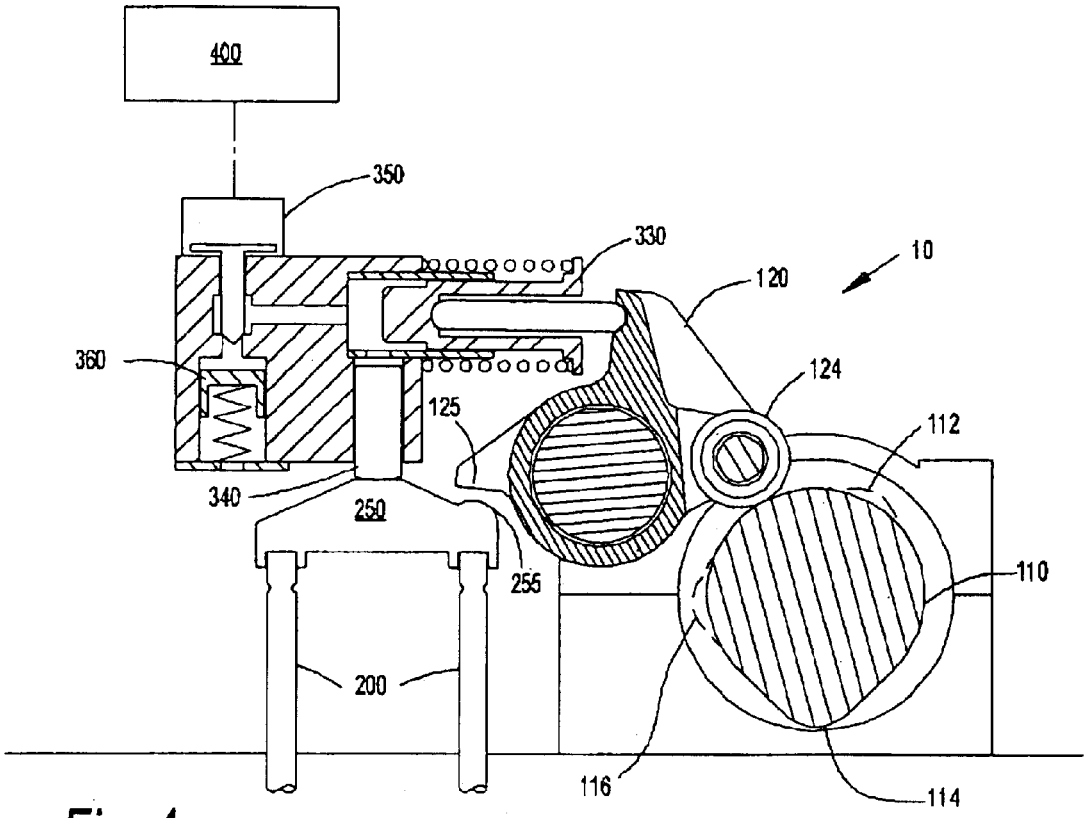
FIG. 4 is a schematic diagram of a valve actuation system according to a fourth embodiment of the present invention.

In an embodiment of the present invention, as shown in FIG. 4, the primary system 300 may comprise a master/slave piston assembly having a master piston assembly 330, a slave piston assembly 340, a trigger valve 350, and an accumulator 360. The master piston assembly 330, the slave piston assembly 340, the trigger valve 350, and the accumulator 360 may be located in bores formed in, for example, an engine housing, and are in communication through a hydraulic circuit formed within the housing. In the embodiment of the present invention shown in FIG. 4, the cam 110 used for an exhaust valve may include an engine braking cam lobe 112, a main exhaust event cam lobe 114, and an EGR cam lobe 116.

As will be apparent to those of ordinary skill in the art, the amount of motion transferred from the motion imparting means 100 through the master piston assembly 330 and the slave piston assembly 340 to the valve 200 is controlled by the trigger valve 350 and the accumulator 360. When the trigger valve 350 is in a closed position, hydraulic fluid is retained in the circuit. As the master piston assembly 330 receives the motion of the cam 110 through the rocker 120, the motion is transferred to the slave piston assembly 340, which moves in a downward direction and ultimately actuates the valve 200. As long as the trigger valve 350 remains closed, the slave piston assembly 340 and the valve 200 respond directly to the motion of the master piston assembly 330, which, in turn, responds to the motion of the cam 110 and the rocker 120. When the trigger valve 350 is opened temporarily, the accumulator 360 and the master-slave circuit may partially drain, and all or part of the hydraulic pressure generated by the master piston 330 may be absorbed by the open circuit rather than be applied to displace the slave piston assembly 340, and correspondingly, the valve 200. The components and arrangement of the primary system 300, as shown in FIG. 4, is for exemplary purposes only. It is contemplated that other components necessary for a properly operating lost motion system may be provided and that the arrangement of the master piston assembly 330, the slave piston assembly 340, the trigger valve 350, and the accumulator 360 may vary depending on a variety of factors, such as, for example, the specification of the engine.

The operation of the actuation means 125 shown in FIG. 4 is similar to that discussed above with reference to FIG. 2. During failure or shut-off of the valve actuation system 10, the actuation means 125 is adapted to contact the contact surface 255, causing the bridge 250 to tilt, and actuate the valve 200, at least partially, and prevent damage to the system.

Operation of the present invention during normal operation of the valve actuation system 10 will now be described with reference to FIG. 4. During positive power, when engine braking valve events may not be desired, the primary system 300 may absorb all or a portion of the motion caused by the engine braking cam lobe 112 on the cam 110. As the cam 110 rotates about the cam shaft, the rocker 120 rotates and transfers the motion to the master piston assembly 330. The motion is not, however, transferred through the slave piston assembly 340 to the valve 200. Rather, the primary system 300 absorbs the motion through, for example, an open trigger valve 350. As the cam 110 approaches the main exhaust lobe 114, the properly operating primary system 300 hydraulically locks, and the motion of the main exhaust lobe is imparted to the master piston assembly 330 and the slave piston assembly 340, causing the slave piston assembly 340 to move in a downward direction and actuate the engine valve 200. As the slave piston 340 moves in a downward direction and begins to actuate the at least one valve 200, the rocker 120 continues to rotate. Simultaneously, the contact surface 255 begins to lower. Thus, the actuation means 125 and the contact surface 255 do not contact, although the surfaces may approach each other closely.

During engine braking, the cam 110 used for an exhaust valve causes the rocker 120 to rotate, which, in turn, pushes on the master piston assembly 330. When the valve actuation system 10 is operating normally, the primary system 300 is hydraulically locked. This causes the entire motion provided by the cam 110 to be transferred through the rocker 120, the master piston 330, and the slave piston 340 to the valve 200 to produce the desired engine valve events.

Operation of the present invention during failure or shut-off of the valve actuation system 10 will now be described with reference to FIG. 4. Shut-off may be controlled by the driver or the control means 400. Failure of the valve actuation system 10 may arise for any number of reasons, including, but not limited to, a lack of hydraulic fluid in the primary system 300, failure of the control means 400, which may include failure of sensors or means connecting the control means 400 to the primary system 300, and/or the failure of the trigger valve 350 in the primary system 300 to close. Failure of the valve actuation system 10 prevents the primary system 300 from properly transmitting the motion from the motion imparting means 100 to the valve 200. During operation of the system 10 using the auxiliary system 125, as the main exhaust event cam lobe 114 acts on the roller 124 and rotates the rocker 120, the actuation means 125 contacts the valve contact surface 255, causing the bridge 250 to tilt, and actuate the valve 200, at least partially. Thus, the actuation means 125 actuates one or more valves 200 to produce at least a portion of the desired engine valve event, preventing potentially catastrophic failure to the system. As discussed above, the present invention may operate during any engine event, such as, for example, engine braking or positive power, and may act on an intake, exhaust, or dedicated braking valve.

It will be apparent to those skilled in the art that variations and modifications of the present invention can be made without departing from the scope or spirit of the invention. Thus, it is intended that the present invention cover all such modifications and variations of the invention, provided they come within the scope of the appended claims and their equivalents.

What is claimed is:

1. A valve actuation system for actuating at least one engine valve in an internal combustion engine to produce an engine valve event, comprising:

means for imparting motion to the at least one engine valve for producing the engine valve event;

primary means for transmitting motion from said motion imparting means to the at least one engine valve; and auxiliary means for transmitting the motion from said motion imparting means to the at least one engine valve, wherein said auxiliary means is integrated with said motino imparting means.

2. The valve actuation system of claim 1, wherein said auxiliary means actuates the at least one engine valve if said primary means is shut-off or fails.

3. The valve actuation system of claim 1, wherein said motion imparting means comprises:

a cam; and a rocker, having means for contacting said cam, and wherein said primary means comprises:

a master/slave piston assembly adapted to selectively receive motion from said cam through said rocker and actuate the at least one engine valve to produce the engine valve event.

4. The valve actuation system of claim 3, wherein said auxiliary means comprises a first contact surface extending from said rocker.

5. The valve actuation system of claim 4, further comprising:

a second contact surface adjacent to the at least one engine valve, wherein said first contact surface contacts said second contact surface and actuates the at least one engine valve to produce at least a portion of the engine valve event.

6. The valve actuation system of claim 5, wherein said second contact surface is provided by a valve bridge.

7. The valve actuation system of claim 6, wherein said second contact surface comprises a pin assembly slidably received in the valve bridge.

8. The valve actuation system of claim 5, wherein said second contact surface is on the at least one engine valve.

9. The valve actuation system of claim 1, wherein said primary means comprises a lost motion system.

10. The valve actuation system of claim 1, wherein the engine valve event is a main exhaust event.

11. The valve actuation system of claim 1, wherein the at least one engine valve is an exhaust valve.

12. The valve actuation system of claim 1, wherein the at least one engine valve is an intake valve.

13. In an internal combustion engine valve actuation system, a method of actuating at least one engine valve to produce at least a portion of an engine valve event during failure or shut-off of a lost motion system contacting a means for imparting motion and the engine valve or an engine valve bridge, said method comprising the steps of:

providing an actuation means extending from the motion imparting means; and actuating the engine valve to produce at least a portion of the engine valve event independent of the lost motion system.

14. A valve actuation system for actuating at least one engine valve in an internal combustion engine to produce an engine valve event, comprising:

a cam;

a rocker, having means for contacting said cam;

a lost motion system adapted to selectively receive motion from said cam through said rocker and actuate the at least one engine valve to produce the engine valve event; and a first contact surface extending from said rocker, wherein said first contact surface actuates the at least one engine valve if said lost motion system is shut-off or fails.

15. The valve actuation system of claim 14, wherein said lost motion system comprises a master/slave piston assembly adapted to selectively receive motion from the cam through the rocker and actuate the at least one engine valve to produce the engine valve event.

16. The valve actuation system of claim 14, further comprising:

a second contact surface adjacent to the at least one engine valve;

wherein said first contact surface contacts said second contact surface and actuates the at least one engine valve to produce at least a portion of the engine valve event.

17. The valve actuation system of claim 16, wherein said second contact surface is provided by a valve bridge.

18. The valve actuation system of claim 17, wherein said second contact surface comprises a pin assembly slidably received in the valve bridge.

19. The valve actuation system of claim 16, wherein said second contact surface is on the at least one engine valve.

20. A valve actuation system for actuating at least one engine valve in an internal combustion engine to produce an engine valve event, said system comprising:

means for imparting motion to the at least one engine valve;

a lost motion system adapted to selectively receive motion from said motion imparting means and actuate the at least one engine valve to produce the engine valve event; and a first contact surface extending from said motion imparting means, wherein said first contact surface actuates the at least one engine valve if said lost motion system is shut-off or fails.

* * * * *